US005564899A

United States Patent [19]

Na

[11] Patent Number: 5,564,899

[45] Date of Patent: Oct. 15, 1996

[54] ENGINE COOLING SYSTEM WITH BLADE ANGLE CONTROLLABLE COOLING FAN

[75] Inventor: Chan-Ju Na, Kyung Nam, Rep. of Korea

[73] Assignee: Samsung Heavy Industry Co., Ltd., Rep. of Korea

[21] Appl. No.: 323,838

[22] Filed: Oct. 17, 1994

[30] Foreign Application Priority Data

Jan. 31, 1994 [KR] Rep. of Korea ..... 94-1821

[51] Int. Cl.[6] ..... F01D 7/00

[52] U.S. Cl. ..... 416/28; 416/39; 123/41.12

[58] Field of Search ..... 416/28, 35, 38, 416/39; 123/41.12, 41.49

[56] References Cited

U.S. PATENT DOCUMENTS

| | | | |
|---|---|---|---|
| 3,467,071 | 9/1969 | Elmer | 416/39 |
| 3,693,575 | 9/1972 | Mades | 416/28 |
| 5,224,446 | 7/1993 | Okita et al. | 123/41.49 |
| 5,299,911 | 4/1994 | Moriya | 416/38 |

FOREIGN PATENT DOCUMENTS

| | | | |
|---|---|---|---|
| 2046816 | 3/1972 | Germany | 416/39 |
| 0057694 | 5/1977 | Japan | 416/35 |
| 0075792 | 7/1977 | Japan | 416/35 |
| 0081600 | 4/1986 | Japan | 416/39 |
| 0242602 | 4/1969 | U.S.S.R. | 416/39 |
| 0754852 | 8/1956 | United Kingdom | 416/39 |

*Primary Examiner*—Thomas E. Denion
*Assistant Examiner*—Mark Sgantzos
*Attorney, Agent, or Firm*—Lieberman & Nowak, LLP

[57] ABSTRACT

An engine cooling system with a blade angle controllable cooling fan. The system has a water temperature sensor, a controller and a pitch actuator. The sensor senses a cooling water temperature and outputs a temperature signal. The controller generates a blade angle control signal on the basis of the temperature signal. The pitch actuator is placed in the interior of a hub of the cooling fan and adjusts a blade angle of the cooling fan in response to the blade angle control signal of the controller.

3 Claims, 4 Drawing Sheets

ENGINE COOLING SYSTEM WITH BLADE ANGLE CONTROLLABLE COOLING FAN

BACKGROUND OF THE INVENTION

1. Field of the Invention

The present invention relates in general to cooling systems suitable to be used with engines of heavy equipment and of construction vehicles and, more particularly, to a structural improvement in such cooling systems for controlling volumes of air delivered by a cooling fan in order to achieve the optimal cooling effect regardless of engine revolutions.

2. Description of the Prior Art

The temperature of combustion gas in a cylinder of an internal combustion engine typically ranges from 2,000° C. to 2,300° C. Most of the heat from the hot combustion gas is absorbed by engine parts such as the cylinder, the cylinder head and the pistons. When the above engine parts become overheated as a result of absorption of the combustion gas heat, either the cylinder may be deformed or the oil film on the cylinder wall may be broken, thus causing improper lubrication of the engine. What is worse, such improper lubrication may cause engine trouble. When the engine parts become overheated as described above, the combustion conditions of the engine become worse and this may generate knocking or pre-ignition of the engine and abruptly reduce the engine output power.

On the contrary, subcooling of the engine will cause a considerable amount of combustion heat to be lost, so that such subcooling of the engine will reduce the thermal efficiency of the engine increasing fuel consumption.

With reference to FIG. 1, there is shown In a block diagram a cooling water circulation circuit of a typical engine cooling system used in heavy equipment.

As shown in this drawing, the typical engine cooling system is a forced circulation cooling system using a water pump designated by the numeral 1. That is, cooling water contained in a water tank 2 is forcibly pumped up by the water pump 1 and passes through heated engine parts such as the cylinder block 3 and the cylinder head 4 of the engine 5. Of course, it should be understood that another coolant instead of the cooling water may be used for cooling the engine 5. While passing through the heated engine parts, the cooling water absorbs the heat of the engine 5 so that the temperature of the cooling water rises. The hot cooling water in turn is introduced into a radiator 8 connected to the cylinder head 4 through a hot water conduit 13. While passing through the radiator 8, the hot water is cooled to a temperature appropriate for optimal operating. The cooled water is, thereafter, returned to the water tank 2 through a cooling water return conduit 10. The above cooling water circulation is repeated during the engine operation.

Placed in back of the radiator 8 is a cooling fan 9 which is coupled to a crankshaft 12 through a fan belt 11. The crankshaft 12, which is rotated by the engine 5, thus rotates the cooling fan 9. The cooling fan 9 produces air currents in order to deliver large volumes of air to the radiator 8, which air passes through the gaps between cooling fins (not shown) of the radiator 8. While passing through the gaps between the cooling fins, the air absorbs the heat of the radiator 8, so that the cooling effect of the cooling system is promoted and the overheated engine 5 is more rapidly cooled.

A water temperature controller 6 is coupled to the hot water conduit 13 between the cylinder head 4 and the radiator 8. This controller 6 directly drains the cooling water to the water tank 2 through a bypass 7 when the water temperature is lower than a predetermined temperature (about 60° C). However, the controller 6 is to introduce the hot cooling water into the radiator 8 when the water temperature is higher than the predetermined temperature. The cooling water, after being sufficiently cooled in the radiator 8, is returned to the water tank 2 through the cooling water return conduit 10.

When the heavy equipment, having the above engine cooling system, carries out work while running on a site, the cooling fan of the above engine cooling system is rotated by the crankshaft at an appropriate speed and produces currents in order to deliver sufficient volumes of air to the radiator, thus promoting a cooling effect of the radiator and to effectively cool the heated engine. However, when the heavy equipment carries out work while being stopped on a site, the crank shaft rotates at low speed, thus rotating the cooling fan at low speed. In this case, the cooling effect of the cooling system is remarkably reduced.

As well known to those skilled in the art, heavy equipment as well as construction vehicles should often carry out heavy work for long periods while being stopped on a site, which heavy work usually requires high output power of the engine. The engine of the heavy equipment or of the construction vehicle thus may be often overheated. The engines of the heavy equipment and of the construction vehicles, therefore, need to be provided with effective cooling systems.

SUMMARY OF THE INVENTION

It is, therefore, an object of the present invention to provide an effective engine cooling system in which the above problems can be overcome and which is particularly profitably used with either heavy equipment or construction vehicles, which equipment or vehicle often carry out heavy work for long periods with high output power of the engine while being stopped on a site, and which cooling system not only effectively prevents overheating of the engine, but also keeps a normal engine temperature, thus to keep optimal engine performance and to improve durability of the engine.

In order to accomplish the above object, an engine cooling system in accordance with an embodiment of the present invention comprises a cooling fan and further comprises means for controlling a blade angle of the cooling fan in accordance with engine temperature and for controlling volumes of air of the cooling fan in order to achieve the optimal engine cooling effect regardless of engine revolutions.

In accordance with the above engine cooling system, the blade angle of the cooling fan is controlled so that much more volumes of air are delivered by the cooling fan to a radiator when the engine is overheated, thus to effectively cool the overheated engine.

BRIEF DESCRIPTION OF THE DRAWINGS

The above, as well as other objects, features and advantages of the present invention will be more clearly understood from the following detailed description taken in conjunction with the accompanying drawings, in which.

DESCRIPTION OF THE PREFERRED EMBODIMENTS

Figure 1:
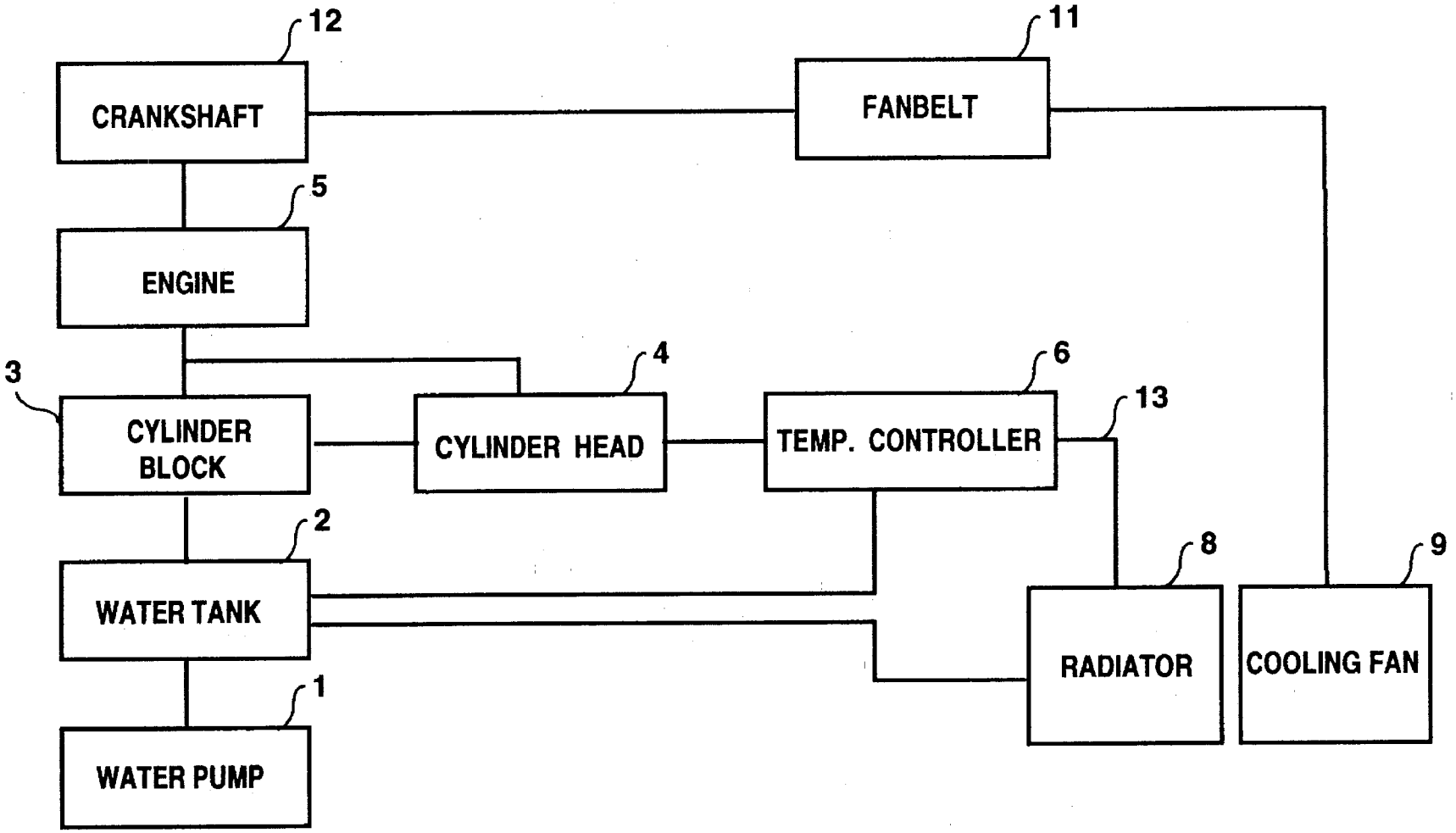
FIG. 1 PRIOR ART
FIG. 1 is a block diagram showing a cooling water circulation circuit of a typical engine cooling system used in heavy equipment.
Figure 2:
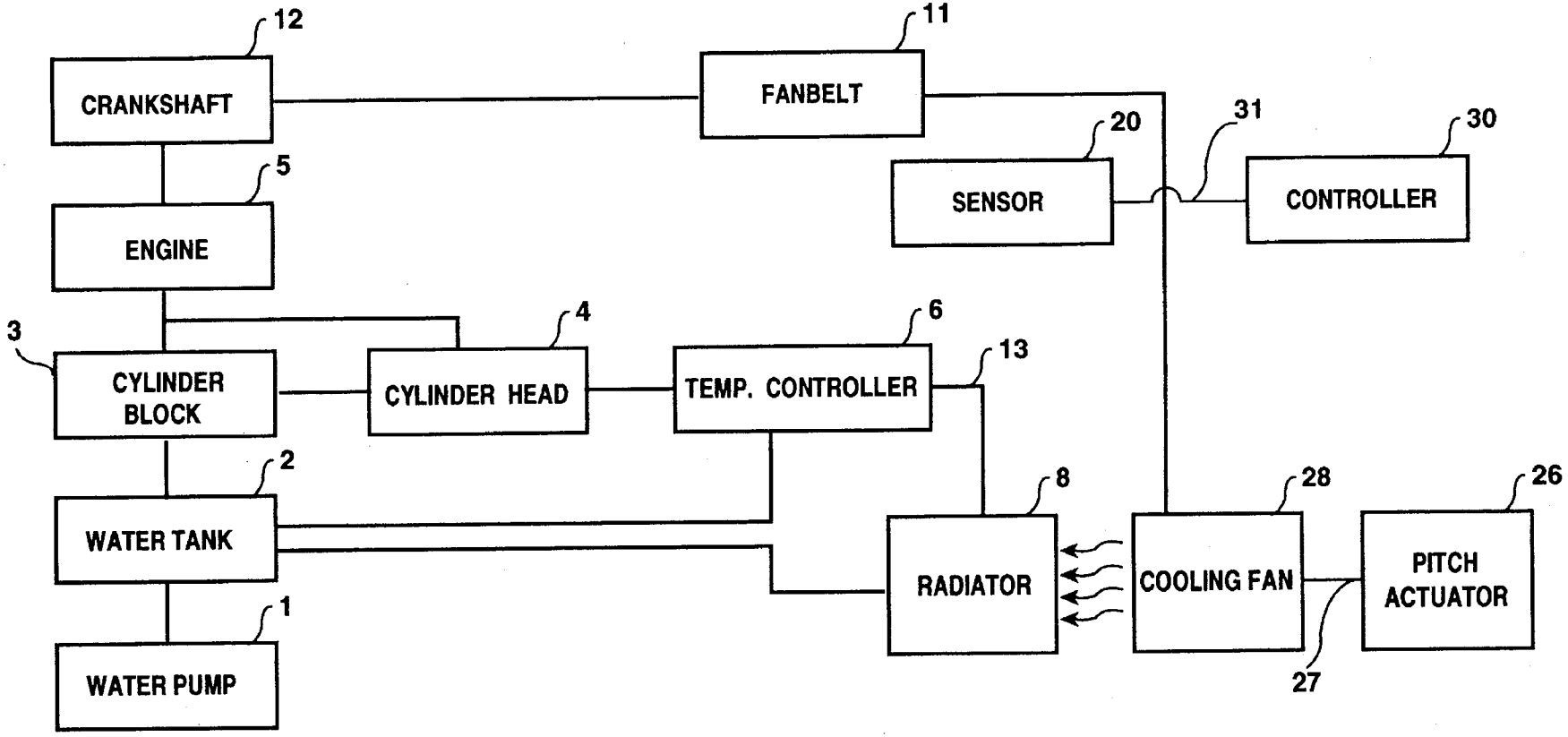
FIG. 2 is a view corresponding to FIG. 1, but showing a preferred embodiment of the present invention.
Figure 3:
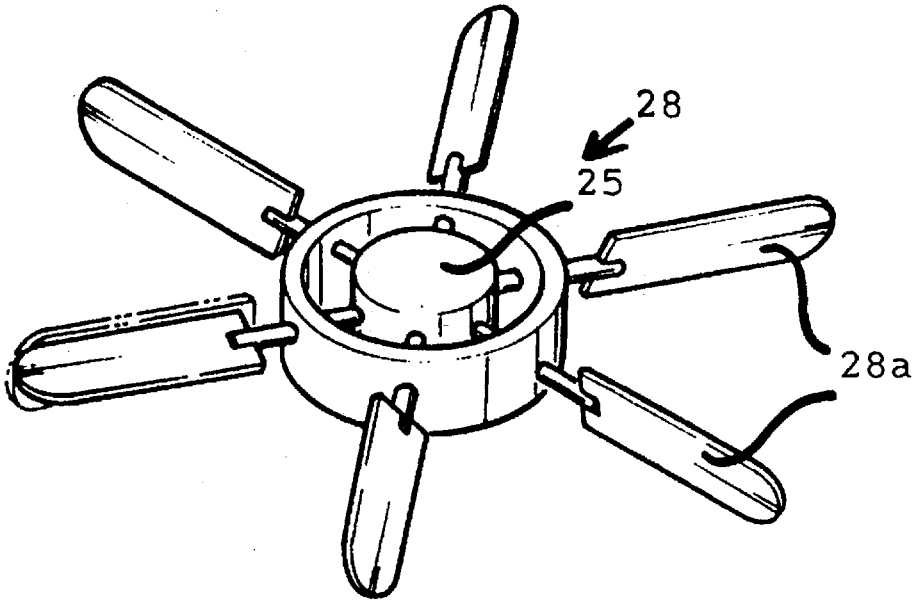
FIG. 3 is a perspective view of a cooling fan of the engine cooling system of the present invention, showing a blade angle control operation.

FIG. 2 is a block diagram showing a cooling water circulation circuit of an engine cooling system in accordance with a preferred embodiment of the present invention and FIG. 3 is a perspective view of a cooling fan of the engine cooling system of the invention, showing a blade angle control operation. Those elements common to both the invention and the prior embodiment will carry the same reference numerals. An explanation for the general construction of the cooling system of the invention is not given in the following description.

In the cooling system of the invention, a water temperature sensor 20 is coupled to a hot water conduit 13 extending between a cylinder block 3 and a radiator 8. The sensor 20 is for sensing the temperature of the cooling water flowing in the hot water conduit 13 after being heated as a result of heat absorption from the heated engine 5. The sensor 20 in turn is electrically connected to a controller 30 through a cable 31 so that the sensor 20 outputs an electric signal, indicating the water temperature to the controller 30

Figure 4:
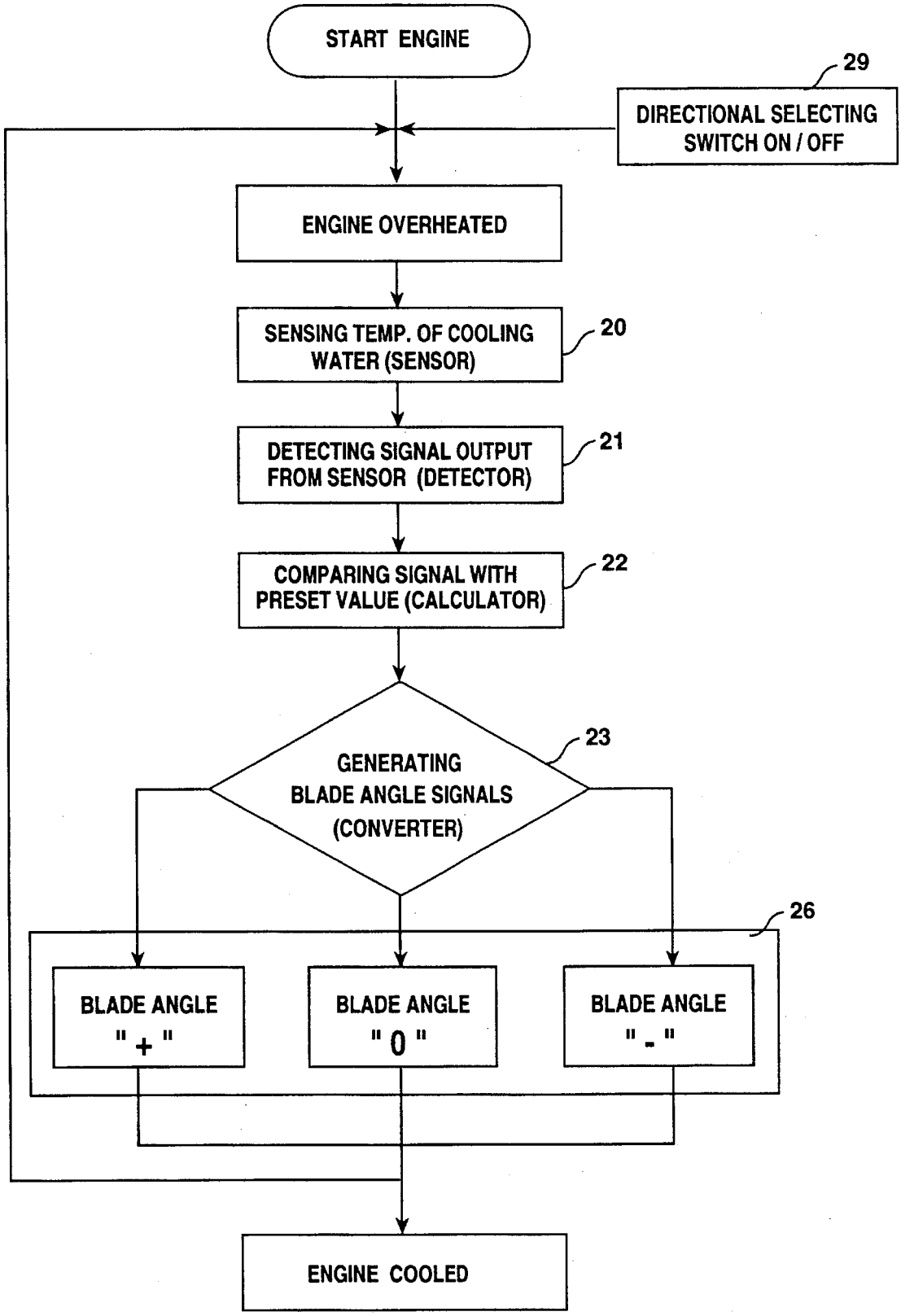
FIG. 4 is a flowchart of a blade angle control method according to the present invention.

The controller, as shown in the flowchart of FIG. 4, has a signal detector 21 which detects the signal output from the water temperature sensor 20 and a calculator 22 coupled to the signal detector 21 which compares a signal value detected by the signal detector 21 with a preset value or a reference value. The controller 30 also has a signal converter 23 which is for converting the compared result of the calculator 22 into a blade angle control signal which will be output to a cooling fan 28 as will be described later herein. In addition, the controller 30 has a signal output unit 24 in order to output the blade angle control signal of the signal converter 23 to the cooling fan 28.

It is preferred to provide an ON/OFF type directional selecting switch 29 for the controller 30, in which the switch 29 selects the blowing direction of the blades 28a of then cooling fan 28 between a forward blowing direction and a backward blowing direction as the situation requires.

As shown in FIGS. 2 and 3, the cooling fan 28, which is connected to the signal output unit 24 of the controller 30, is provided with a pitch actuator 26 through a control cable 27. The actuator 26 is placed in the interior of a hub 25 of the fan 28 and controls the angle of the blades 28a in response to the blade angle control signal output from the signal output unit 24 of the controller 30. The blade angle changing mechanism of the pitch actuator 26 is well known in the blade angle control field such as a typical controllable pitch actuator conventionally used for controlling the propeller angle of a ship, thus further explanation is not deemed necessary.

The operational effect of the above cooling system will be given hereinbelow.

Looking closely at the present embodiment of the cooling system, the directional selecting switch 29 of the controller initially selects either the forward blowing direction or the backward blowing direction of the cooling fan 28. If the backward blowing direction of the fan 28 is selected so that the cooling fan 28 blows volumes of air on the radiator 8, the cooling water of the water tank 2 is pumped up by the water pump 1 so as to pass through both the cylinder block 3 and the cylinder head 4 of the engine 5. While passing through the cylinder block 3 and the cylinder head 4, the cooling water absorbs the heat of the heated engine 5 so that the water is heated. The heated cooling water flows in the hot water conduit 13 and, at this time, the temperature of the cooling water is sensed by the water temperature sensor 20. The sensor 20 converts the sensed water temperature into an electric signal which in turn is applied to the controller 30 through the cable 31. In the controller 30, the signal output from the sensor 20 is primarily detected by the signal detector 21 so that information for the water temperature is detected. The detected signal value of the signal detector 21 in turn is applied to the calculator 22.

Upon reception of the detected signal value, the calculator 22 compares the signal value with a preset value or a reference value. The preset value or the reference value was memorized in the calculator 22 and corresponds to optimal operational conditions of the engine 5 of the heavy equipment. As a result of comparison of the detected signal value with the preset value, the calculator 22 analyzes the overheated state of the engine 5. The compared result of the calculator 22 is applied to the signal converter 23. In the cooling system of the invention, the range of the reference value as well as the range of the compared value of the calculator 22 may be appropriately changed in accordance with both the kind of coolant and characteristics of the engine 5. In this regard, the type of cooling system of the invention may be freely changed In accordance with the working conditions of the heavy equipment. The compatibility of the cooling system of the invention is thus improved in comparison with the prior cooling system which should be fixed to a specified type according to the heavy equipment.

Upon reception of the compared result from the calculator 22, the signal converter 23 checks the compared result and classifies the desired blade angle into three patterns on the basis of the compared result. That Is, the signal converter 23 classifies the desired blade angle into an angle equal to the initial angle, an angle less than the initial angle, or an angle larger than the initial angle, the three angles being represented by symbols "0", "–" and "+" respectively.

Thereafter, the signal converter 23 applies a blade angle control signal, corresponding to one of the symbols "0", "–" and "+", to the pitch actuator 26 of the cooling fan 28 through the signal output unit 24. The pitch actuator 26 operates in response to the blade angle control signal so that the actuator 26 appropriately adjusts the blade angle. The cooling fan 28 blows the appropriate volume of air on the radiator 8, thus promoting a radiating effect to the radiator 8 and achieving optimal thermal conditions for the engine 5.

The cooling system of the invention freely controls the blowing direction of the cooling fan 28 as well as the air flow while keeping constant rotational speed of the fan 28, which is rotated by the rotational force of the crankshaft 12. The cooling system thus more effectively cools the heated cooling water. The blade angle controllable cooling fan 28 of the above cooling system frees the system of elements for control of the rotating speed of the fan 28. The cooling fan 28 also prevents operational noise and vibration, and fatigue of the fan belt 11, mainly caused when the fan 28 is rotated at exceedingly high speeds. The operational reliability and durability of the cooling system is thus remarkably improved.

When selecting the forward blowing direction of the fan 28 by handling the directional selecting switch 29, the blades of the fan 28 are turned to 180° C. so that the volumes of air are directed from the engine 5 to the radiator 8. In this case, the engine 5 is rapidly cooled to a normal temperature, particularly when it is overheated.

When the cooling system uses another coolant instead of the cooling water, the water temperature sensor 20 will be substituted with other means which will be appropriately used with the another coolant. When the present invention is adapted for another device such as an electric fan or a ventilation fan, the water temperature sensor 20 of the system will be substituted with another sensing means such as a speed sensor, a temperature sensor or a humidity sensor. In this case, the blowing operation of the fan 28, which has no additional element for controlling the blowing direction and air flow of the fan 28, will be rapidly and precisely controlled.

As described above, the present invention provides an effective engine cooling system which is particularly profitably used in either heavy equipment or construction vehicles, which equipment or vehicles often carry out heavy work for a long period with high output power of the engine while being stopped on a site. The cooling system not only effectively prevents overheating of the engine but also maintains a normal engine temperature, thus keeping optimal engine performance and improving durability of the engine.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. An engine cooling system with a cooling fan, comprising:

a water temperature sensor coupled to a cooling water conduit, said sensor sensing the cooling water temperature and outputting a temperature signal;

a controller generating a blade angle control signal based on the temperature signal of the water temperature sensor and outputting the blade angle control signal; and a pitch actuator provided at the interior of a hub of the cooling fan, said pitch activator controlling the blade angle of the cooling fan in response to the blade angle control signal of the controller, whereby the volume of air provided by the cooling fan is controlled regardless of engine revolutions.

2. The engine cooling system according to claim 1, wherein said controller includes:

a signal detector detecting said temperature signal of the water temperature sensor in order to generate a detected signal value;

a calculator comparing said detected signal value of the signal detector with a preset value in order to analyze the overheated state of the engine;

a signal converter converting a compared result of said calculator into the blade angle control signal; and a signal output unit outputting the blade angle control signal of the signal converter to said pitch actuator.

3. The engine cooling system according to claim 1 or claim 2 wherein said blade angle controller means further comprises:

a switch for selecting the blowing direction of the cooling fan between a forward blowing direction and a backward blowing direction by directing the blades of the cooling fan backwards or forwards, said switch reversing the blowing direction of the cooling fan when the engine is overheated.

* * * * *